United States Patent [19]

Deussen

[11] Patent Number: 4,469,234

[45] Date of Patent: Sep. 4, 1984

[54] TAMPERPROOF CONTAINER CLOSURE

[76] Inventor: Werner Deussen, Scharfensteinstr. 17, D-6228 Eltville (Rhein), Fed. Rep. of Germany

[21] Appl. No.: 463,831

[22] Filed: Feb. 4, 1983

Related U.S. Application Data

[63] Continuation-in-part of Ser. No. 442,785, Nov. 18, 1982, abandoned, which is a continuation-in-part of Ser. No. 395,085, filed as PCT DE81/00172, Oct. 9, 1981, § 102(e) date Jun. 19, 1982, abandoned.

[30] Foreign Application Priority Data

Oct. 11, 1980 [DE] Fed. Rep. of Germany ..... 3038453
Nov. 20, 1981 [PT] Portugal ..... 74017

[51] Int. Cl.[3] ..... B65D 41/34
[52] U.S. Cl. ..... 215/252
[58] Field of Search ..... 215/252, 258

[56] References Cited

U.S. PATENT DOCUMENTS 3,650,428 3/1972 Miller ..... 215/252
3,737,064 6/1973 Patel et al. ..... 215/258 X
4,147,268 4/1979 Patel et al. ..... 215/258 X

FOREIGN PATENT DOCUMENTS 2024990 12/1971 Fed. Rep. of Germany .

*Primary Examiner*—Donald F. Norton
*Attorney, Agent, or Firm*—Karl F. Ross; Herbert Dubno

[57] ABSTRACT

A closure for bottles or other containers with a threaded neck comprises an internally threaded plastic cap adapted to be screwed onto that neck with the aid of a socket wrench, the rim of the cap being connected via several frangible webs with a telltale ring of like material carrying a set of peripherally spaced-apart lugs with inbent extremities elastically hooked onto a peripherally projecting flanges of the container neck to prevent an unscrewing of the cap without detachment of the telltale ring therefrom. The ring, which has notches engageable by the socket wrench for positive entrainment, is integral with a skirt spacedly surrounding the lugs and projecting beyond them to forestall any attempt at disengaging their extremities from the flange before unscrewing the cap. The flange, overhanging an annular shoulder of the container body on which the skirt comes to rest in the assembled position, has detents in the form of two diametrically opposite ramps which terminate in radial edges coacting with adjacent lugs of the ring to limit any relative backward rotation thereof.

20 Claims, 4 Drawing Figures

TAMPERPROOF CONTAINER CLOSURE

CROSS REFERENCE TO RELATED APPLICATIONS

This is a continuation-in-part of my copending application Ser. No. 442,785 filed 18 Nov. 1982 as a continuation-in-part of my earlier application Ser. No. 395,085 filed as PCT DE 81/00172, Oct. 9, 1981, § 102(e) date June 10, 1982 both now abandoned.

FIELD OF THE INVENTION

My present invention relates to a closure for a container such as a bottle or a jar, which has a threaded neck engageable by a substantially cylindrical, complementarily threaded cap in order to seal its contents.

BACKGROUND OF THE INVENTION

In many instances it is important to provide such a closure with means indicating to a user whether the container bears the original seal or has previously been opened. For this purpose it is known, e.g. from German published specification No. 20 24 990, to provide the screw cap of the closure with a telltale ring secured to its rim by frangible webs and designed to engage a radially outwardly projecting peripheral flange of the container neck disposed between its screw threads and the container body. Upon the first unscrewing of the cap, the telltale ring if forcibly detached therefrom since it is retained by the flange. With the cap and its ring generally consisting of plastic material, the ring originally fits loose around the neck and is thereafter thermally deformed to underreach the peripheral flange so as not to be disengageable therefrom by simple mechanical means.

In my first-filed application (Ser. No. 395,085) referred to above, I have disclosed and claimed an improved closure of this general type in which the telltale ring is provided with a set of peripherally spaced-apart lugs with inbent extremeities that are elastically hooked onto the peripheral flange of the container neck upon the initial emplacement of the cap thereon. This eliminates the need for a thermal deformation of the ring since the lug extremities snap into position by virtue of their inherent elasticity. Advantageously, these extremities are designed as barbs including an acute angle with the stems supporting them, these stems being preferably heavier than the barbs so as to resist any effort at bending them away in order to disengage the barbs from the shoulder of the container neck.

Even so, however, the closure may not be entirely safe from tampering since it is conceivable that someone may succeed in deflecting the barbs with the aid of, say, an arcuately bent wire.

OBJECT OF THE INVENTION

The object of my present invention, therefore, is to further improve the closure described in my first-filed application so as to make it virtually tamperproof.

SUMMARY OF THE INVENTION

I realize this object, in accordance with my present invention, by providing the telltale ring of the closure with a skirt spacedly surrounding its lugs and projecting beyond their inwardly projecting extremities for protecting same against attempts to disengage them from the flange of the container neck.

This measure alone, however, may not suffice to ensure the desired tamperproofness under all circumstances. Unless the container neck has a somewhat intricate shape impeding its moldability, a manipulator could carefully rotate the cap in reverse to tension the lugs while avoiding rupture of the webs; thereafter, the skillful use of a slender tool inserted between the skirt and the neck could detach the tensioned lugs one by one from the flange to enable a complete unscrewing with the telltale ring intact.

Pursuant to a further feature of my invention, therefore, I provide the peripheral flange of the container neck with one or more radial undercuts engageable with the stems of adjacent lugs to limit a possible reverse relative rotation of the neck and the telltale ring to less than the angular pitch of the lugs. Advantageously, in this connection, both the cap and the ring are provided with formations such as ribs and/or notches concurrently engageable by an assembling tool—e.g. a socket wrench—during the initial emplacement of the cap so as to obviate any possible rotational lag of the ring behind the cap which would increase the range of reverse rotatability. The undercuts could be formed by terminal edges of two diametrically opposite ramps on the neck flange which are easily produced in a split mold along with the male threads of the neck; a preferably flat or possibly frustoconical annular shoulder located below the flange, against which the skirt comes to rest in the virginal container-sealing position, then provides sufficient safety against inadmissible manipulation. The ramps are representative of a variety of detent means that can be used for the purpose described.

BRIEF DESCRIPTION OF THE DRAWING

The above and other features of my invention will now be described in detail with reference to the accompanying drawing in which.

SPECIFIC DESCRIPTION

Figure 1:
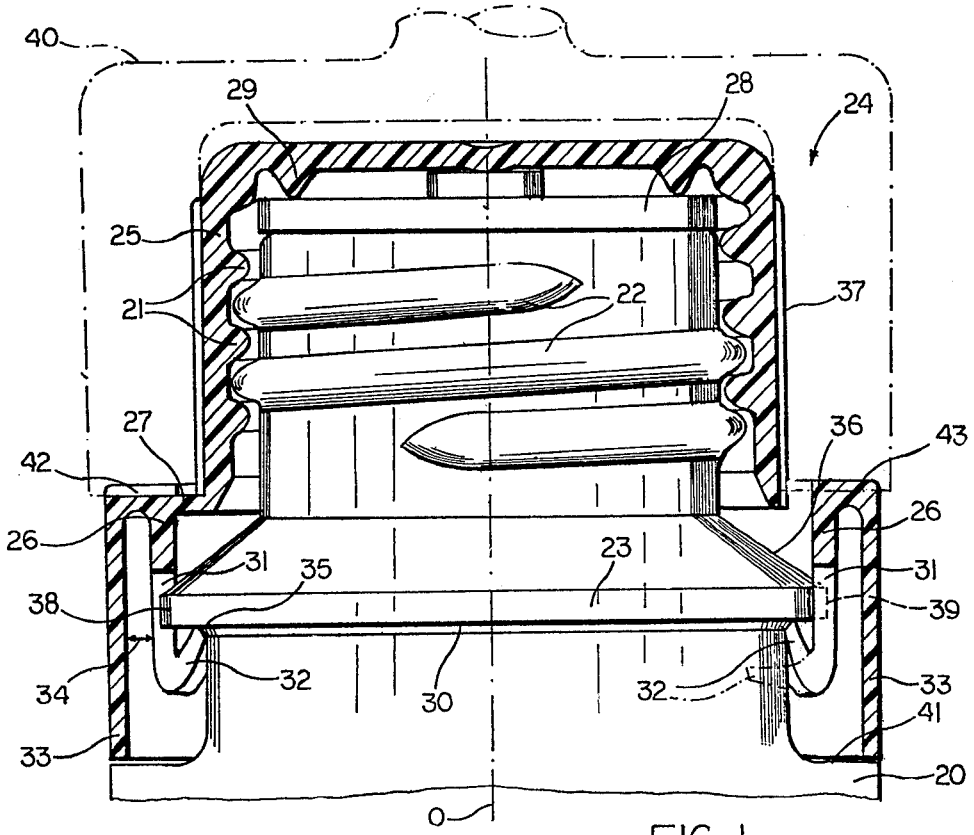
FIG. 1 is an axial sectional view of a closure embodying my present invention, shown screwed onto a neck of a bottle.
Figure 2:
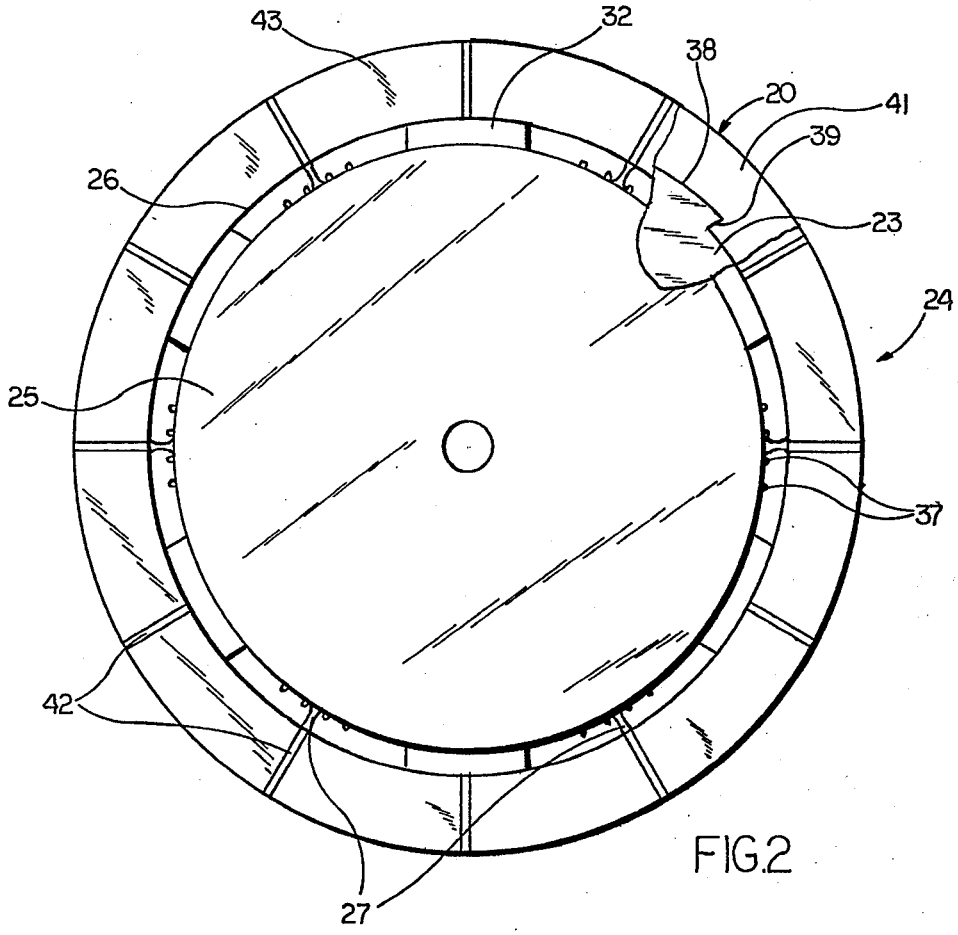
FIG. 2 is a top view (partly broken away) of the closure illustrated in FIG. 1.

In FIGS. 1 and 2 I have shown a closure 24 for a bottle 20 which has a neck provided with male threads 22 and a peripheral flange 23 below these threads. Closure 24 comprises a cap 25 with female threads 21, mating with the threads 22 of the bottle neck, and a telltale ring 26 integrally connected with the rim of that cap via several peripherally spaced-apart frangible webs 27. Ring 26 is provided with a multiplicity of peripherally equispaced depending lugs having stems 31 and inbent, re-entrant extremities of reduced thickness forming barbs 32. These barbs, including with stems 31 an acute angle of about 30° in the illustrated assembled position, have end faces 35 including a similar angle with a plane transverse to the axis 0 of closure 24 and bottle 20; the latter angle corresponds to that of a beveled lower surface 30 of flange 23 which the barbs 32 abut under a biasing force tending to deflect them inward toward axis 0. This biasing force is due to the fact that, prior to assembly, the angle included between the barbs and the stems is greater than that illustrated in FIG. 1. More particularly, with the closure molded integral from thermoplastic or thermosetting polymeric material, the barbs may initially point generally radially inward, as illustrated in phantom lines; this will also facilitate the separation of the closure from a collapsible core used in the molding process. Suitable polymeric materials include, for example, polystyrene, polyesters and polyolefins as well as melamine resins. To facilitate its manual rotation, as by a socket wrench 40 also illustrated in phantom lines, cap 25 is externally provided with axially extending ribs 37.

The closed end of cap 25 is internally provided with an annular boss 29 bearing upon an insert 28 of relatively soft material serving as a plug or as a drop dispenser.

The closure so far described corresponds to that disclosed in my first-filed application identified above.

In accordance with my present improvement, the telltale ring 26 is formed integral with a substantially cylindrical skirt 33 surrounding the stems 31 of the neck-gripping lugs with an annular clearance 34 and projecting beyond their extremities 32. The width of clearance 34 should be sufficient to facilitate the slight outward deflection which the stems 31 have to undergo when closure 24 is first fitted with a screwing motion onto the threaded neck of bottle 20, with the barbs 32 squeezed against the stems by a frustoconical neck surface 36 adjoining the flange 23. The skirt 33 comes to rest, in the assembled position illustrated, on a transverse annular shoulder 41 formed by the body of bottle 20.

Figure 4:
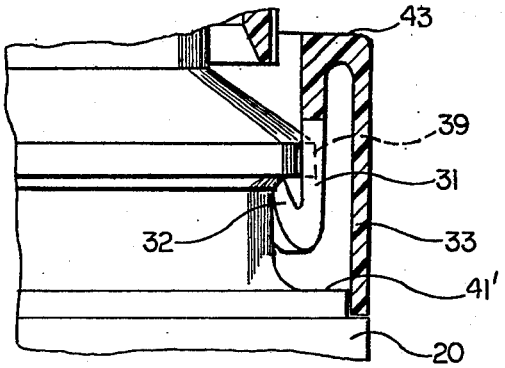
FIG. 4 is a fragmentary detail view showing another modification.

In order to frustrate any attempt to separate the skirt 33 from the shoulder 38 and to tension the lugs 31, 32 by a reverse rotation of cap 25 relative to bottle 20, which could enable the insertion of a blade for an unauthorized detachment of the barbs 32 from flange surface 30, the flange 23 is slightly increased in radius at diametrically opposite locations to form a pair of mutually symmetrical ramps 38—one of them seen in FIG. 2—terminating in transverse edges 39 which act as radial undercuts projecting behind the stems 31 of adjacent lugs when they have snapped into their flange-engaging positions. The ring 26 further has a flat top 43 formed with a multiplicity of radial notches 42 which are engageable by coacting teeth of socket wrench 40 when the cap 25 is initially screwed on, thereby ensuring that the ring corotates with the cap during that operation. A relative rotation in the unscrewing direction is thus limited to a small fraction of a turn which is less than the peripheral pitch of the lugs, i.e. the spacing of the rearwardly facing edges of adjoining stems 31 from each other. In principle, therefore, a detachment of the cap from the bottle without rupture of webs 27 would be prevented even if there were no barbs 32 at the free ends of these stems in engagement with flange 23; the presence of these barbs, however, increases the safety of my closure. That safety could be further enhanced by providing the shoulder 41 of the container body with a peripheral step embraced by the lower end of skirt 33; this has been illustrated at 41' in FIG. 4 which shows part of an assembly otherwise identical with that of FIGS. 1 and 2.

Figure 3:
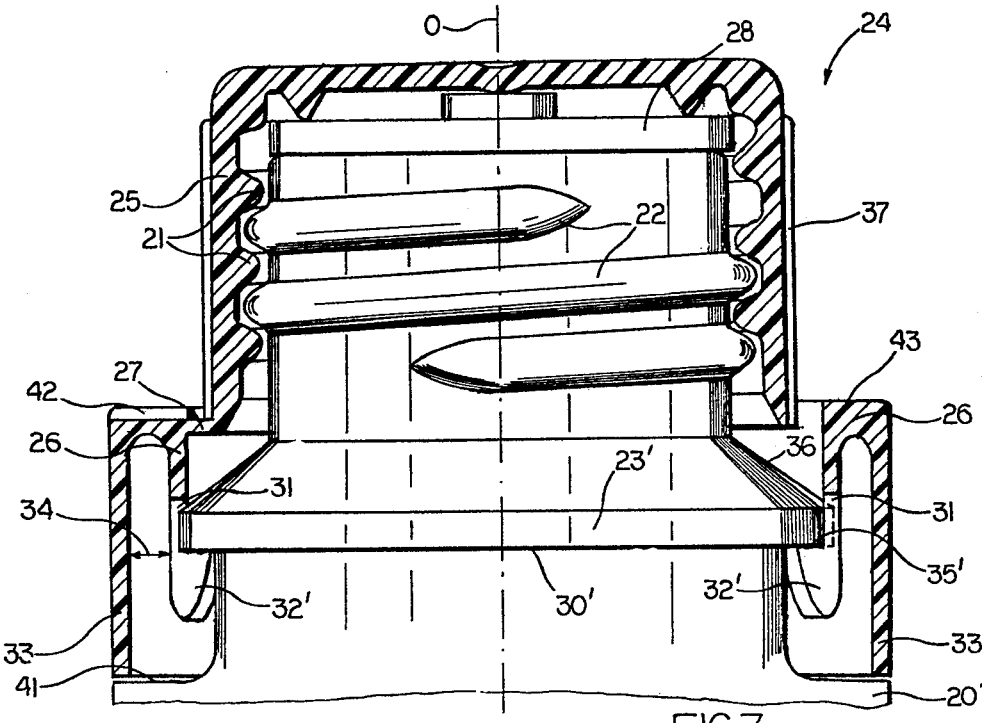
FIG. 3 is a view similar to that of FIG. 1, illustrating a modification.

When the neck of the bottle has a flange 23' terminating in a planar underside 30', as shown in FIG. 3, the lugs of telltale ring 26 may be modified so that their stems 31 have enlarged, downwardly tapering extremities 32' with flat ledges 35' contacting the surface 30' from below. Such a configuration, without the skirt 33, has also been disclosed in my first-filed application. The structure of FIG. 3 is more robust than that of FIG. 1 but, were it not for the protective skirt, would be easier to detach without trace from the container neck. The additional safety features described with reference to FIGS. 1 and 2 apply, of course, also to this embodiment.

I claim:

1. A closure for a container having a body provided with a threaded neck and a radially outwardly projecting peripheral flange located between the threads thereof and said body, comprising:

a substantially cylindrical cap of resiliently deformable material provided with internal threads mating with those of the container neck;

a telltale ring of like material connected to the rim of said cap by frangible webs, said ring being provided with peripherally spaced-apart lugs having inwardly projecting extremities resiliently hooked onto said flange upon an initial screwing of said cap onto said neck, thereby preventing any unscrewing of said cap from said neck without forcible detachment of said ring from said rim; and a skirt on said ring spacedly surrounding said lugs and projecting beyond said extremities for protecting same against attempts to disengage them from said flange.

2. A closure as defined in claim 1 wherein said lugs have stems extending substantially parallel to the axis of said cap, said extremities forming inbent barbs approaching said axis at an acute angle to said stems upon said cap being screwed onto said neck.

3. A closure as defined in claim 2 wherein said barbs are substantially thinner than said stems.

4. A closure as defined in claim 2 wherein said barbs are biased to bear generally radially inward upon said neck while engaging said flange.

5. A closure as defined in claim 1 wherein said cap and said ring are provided with formations jointly engageable by an assembling tool for concurrent rotation thereby during the initial screwing of said cap onto said neck.

6. A closure as defined in claim 1 wherein said lugs have stems extending substantially parallel to the axis of said cap, said extremities being enlargements of said stems forming substantially planar ledges.

7. In combination, a container having a body provided with a threaded neck and with a radially outwardly projecting peripheral flange located between the threads thereof and said body, and a closure for said container comprising:

a substantially cylindrical cap of resiliently deformable material provided with internal threads in mating engagement with the threads of said neck;

a telltale ring of like material connected to the rim of said cap by frangible webs, said ring being provided with peripherally spaced-apart lugs having inwardly projecting extremities resiliently hooked onto said flange to prevent any unscrewing of said cap from said neck without rupture of said webs and resulting forcible detachment of said ring from said rim; and a skirt on said ring spacedly surrounding said lugs and projecting toward said body beyond said extremities for protecting same against attempts to disengage them from said flange.

8. The combination defined in claim 7 wherein said skirt extends close to a bulging portion of said body adjoining said neck.

9. The combination defined in claim 7 wherein said lugs have stems extending substantially parallel to the axis of said cap, said extremities forming inbent barbs approaching said axis at an acute angle to said stems.

10. The combination defined in claim 9 wherein said barbs are substantially thinner than said stems.

11. The combination defined in claim 9 wherein said flange is bounded by a beveled surface remote from said threads, said barbs having end faces inclined to said axis at an angle conforming to that of said beveled surface.

12. The combination defined in claim 7 wherein said lugs have stems extending substantially parallel to the axis of said cap, said extremities being enlargements of said stems forming substantially flat ledges in contact with said flange.

13. The combination defined in claim 7 wherein said flange is provided with at least one radial undercut engageable with an adjoining lug of said ring for limiting any relative rotation of said ring and said neck in an unscrewing direction to a small fraction of a turn.

14. The combination defined in claim 13 wherein said cap and said ring are provided with formations jointly engageable by an assembling tool for concurrent rotation thereby during an initial screwing of said cap onto said neck.

15. The combination defined in claim 13 wherein said undercut is an edge of one of two symmetrical, diametrically opposite peripheral ramps of said flange.

16. The combination defined in claim 7 wherein said body has a stepped annular shoulder engaged by said skirt.

17. In combination, a container having a body provided with a threaded neck and with a radially projecting peripheral flange located between the threads thereof and said body, and a closure for said container comprising:

a substantially cylindrical cap of resiliently deformable material provided with internal threads in mating engagement with the threads of said neck;

a telltale ring of like material connected to the rim of said cap by frangible webs, said ring being provided by peripherally spaced-apart lugs, said flange being provided with detent means engageable with an adjoining lug of said ring for limiting any relative rotation of said ring and said neck in an unscrewing direction to a small fraction of a turn; and a skirt on said ring spacedly surrounding said lug and contacting an annular shoulder of said body for protecting said lugs against attempts to disengage any of them from said detent means.

18. The combination defined in claim 17 wherein said detent means comprises symmetrical, diametrically opposite peripheral ramps of said flange terminating at radially extending edges.

19. The combination defined in claim 17 wherein said cap and said ring are provided with formations jointly engageable by an assembling tool for concurrent rotation thereby during an initial screwing of said cap onto said neck.

20. The combination defined in claim 17 wherein said formations are axially extending ribs on said cap and radial notches on a flat top of said ring.

* * * * *